US006384742B1

(12) United States Patent
Harrison

(10) Patent No.: US 6,384,742 B1
(45) Date of Patent: May 7, 2002

(54) PEDESTRIAN CROSSWALK SIGNAL APPARATUS—PEDESTRIAN CROSSWALK

(76) Inventor: Michael A. Harrison, 10992 Rio Ruso Dr., Windsor, CA (US) 95492

( * ) Notice: Subject to any disclaimer, the term of this patent is extended or adjusted under 35 U.S.C. 154(b) by 0 days.

(21) Appl. No.: 09/649,639

(22) Filed: Aug. 28, 2000

Related U.S. Application Data

(63) Continuation-in-part of application No. 09/039,877, filed on Mar. 16, 1998, now abandoned, which is a continuation-in-part of application No. 08/680,275, filed on Jul. 11, 1996, now abandoned, which is a continuation-in-part of application No. 08/257,334, filed on Jun. 8, 1994, now abandoned.

(51) Int. Cl.[7] ..... G08G 1/95

(52) U.S. Cl. ..... 340/944; 340/908.1; 340/925; 340/917

(58) Field of Search ..... 340/908.1, 925, 340/944, 917

(56) References Cited

U.S. PATENT DOCUMENTS 5,406,276 A * 4/1995 Ogle ..... 340/944
5,572,202 A * 11/1996 Regel et al. ..... 340/901
5,654,705 A * 8/1997 Houten et al. ..... 340/944

* cited by examiner

*Primary Examiner*—Daryl Pope
(74) *Attorney, Agent, or Firm*—Johnson & Stainbrook, LLP; Larry D. Johnson; Craig M. Stainbrook

(57) ABSTRACT

A traffic warning system which alerts approaching vehicle traffic to the presence of a pedestrian in a crosswalk. The system includes a plurality of surface mounted lights partially embedded in and placed across a roadway. The lights are activated by the pedestrian, either by manual switch or by a sensor, before he enters the crosswalk. Once activated, the flashing lights warn drivers of approaching vehicles that the pedestrian may have entered the crosswalk, and that caution should be exercised.

15 Claims, 5 Drawing Sheets

*Light Guard Systems*
*Report Generator*

Location: 1500 Santa Rosa Blvd Last Report 931201
Date: Dec 15, 1993

Activity: Last 24 hours

| | |
|---|---|
| **1100 - 1115** | **E=25 W=32** |
| **1115 - 1130** | **E=20 W=10** |
| **1400 - 1415** | **E=37 W=12** |

System Status: Normal +++ No faults detected.
Current Battery condition: +13.1 CHARGED End Report.....

40

PEDESTRIAN CROSSWALK SIGNAL APPARATUS— PEDESTRIAN CROSSWALK

This application is a continuation-in-part of application Ser. No. 09/039,877, filed Mar. 16, 1998, now abandoned which was a continuation-in-part of application Ser. No. 08/680,275, filed Jul. 11, 1996, and now abandoned, which was a continuation-in-part of application Ser. No. 08/257,334, filed Jun. 8, 1994, and now abandoned.

BACKGROUND OF THE INVENTION

1. Field of the Invention

This invention relates generally to lighting and signal warning devices, and more specifically to an improved pedestrian crosswalk signal apparatus.

2. Description of the Prior Art

Current pedestrian crosswalk designations are inadequate for many locations and lighting conditions. For example, stripes painted on the surface of the pavement are difficult to see even under optimum circumstances, and crosswalk caution signs are all too often lost in the background clutter of business signs, buildings, and temporarily parked delivery trucks and vans. Street lighting systems and traffic signals are useful to help designate crosswalk locations, but these can be extremely expensive to install and maintain and, therefore, are reserved for only the busiest locations.

Although pedestrian safety concerns are usually associated with young people, a recent analysis of pedestrian/vehicle collisions which resulted in either serious injury or death has determined that elderly or developmentally disabled individuals were the highest risk groups, even though they were using a crosswalk appropriately when struck. It is therefore apparent that an improved system needs to be developed for alerting traffic to the presence of a pedestrian in a crosswalk.

Some devices have been developed in an attempt to address this problem. For example, Ogle U.S. Pat. No. 5,406,276 provides a cross-walk warning light system which detects a pedestrian entering the cross-walk and activates a light which is aimed across the intersection, so that an approaching driver might see this beam of light and be warned of the presence of the pedestrian. However, this system directs light parallel to the crosswalk, i.e., perpendicular to the roadway and along the pedestrian's path of movement, and thus is designed to illuminate the pedestrian (and/or airborne particulate matter in the ambient air). This may be problematic in that only a portion of the light may actually be seen by the driver of the approaching vehicle. Furthermore, in this system the lights themselves are carried on support poles located on the sidewalks adjacent to the roadway. Thus, the light emanates from the sides of the roadway, and not in the roadway directly in front of the driver, further reducing the likelihood that the light will be seen by an approaching driver.

SUMMARY OF THE INVENTION

The pedestrian crosswalk signal apparatus of this invention provides a low-cost traffic warning system which is self-contained, easily retrofitted to existing crosswalk locations and designed to alert approaching vehicle traffic to the presence of a pedestrian in a crosswalk. The inventive system includes a plurality of above-pavement, surface mounted lights, installed in a fashion similar to currently used road reflectors, and which are partially embedded in a roadway and placed across the roadway, e.g., adjacent to and parallel with the existing stripes designating a crosswalk, and constructed so that they are impervious to vehicle traffic over them. The lights are activated by the pedestrian, either by manual switch or by sensor, before he or she enters the crosswalk. Once activated, the lights flash in the direction of oncoming traffic, and emanate directly from the roadway, to warn drivers of approaching vehicles that a pedestrian may have entered the crosswalk, and that caution should be exercised.

The warning lights may be installed facing only the oncoming traffic, or across the entire length of the crosswalk, or in any other manner. When actuated, the system can flash the lights in a sequence to be determined, warning oncoming traffic of the pedestrian entering the crosswalk. The lights will remain flashing until the pedestrian has safely exited the crosswalk. The timing sequence can be similar to existing cycles used in wait-walk signal applications.

A switch can be provided on both sides of the street to allow activation of the system by a pedestrian. The switches can be a mechanical pole-mounted design, or proximity actuated switches (e.g., infrared sensors), or any other type of activation device.

The level of illumination can be designed to conform with existing illumination standards for traffic control devices and further modified for either daytime or nighttime use. An ambient light sensing circuit may be provided to adjust light intensity to dynamically compensate for poor visibility and night operating conditions.

The inventive apparatus can include data storage circuitry to collect additional data such as the number of pedestrians activating the apparatus, the direction of travel by the pedestrian and the number of vehicles approaching or passing over the apparatus by time of day. The inventive system may include report generation capability which can be useful in determining how frequently the crosswalk is used and the heavy or light usage time periods. These capabilities can be expanded to include other data which the system owner may find useful in preparing future strategies.

While initially envisioned for use exclusively along crosswalks at uncontrolled intersections, the inventive apparatus may have application at controlled intersections.

The inventive system can be installed virtually anywhere standard crosswalk markings are deemed to be ineffective, or where the installation problems of high cost traffic signals are impractical. The use of surface mounted lights afford minimal impact to the existing roadway or surface, which keeps installation simple and cost effective.

The inventive system can be conventionally powered (e.g., from existing overhead or underground power lines) or solar powered for stand-alone applications. For example, the lighting system may be powered by a twelve volt power source consisting of a solar panel, maintenance free battery and a charging circuit. The system may utilize proven solar technology to allow stand alone operation, thus eliminating the need for existing electrical power at the installation site. A pole mounted solar panel provides all the necessary power for operating the system while a maintenance free battery provides backup power during night or low light conditions. The solar panel can be sized to ensure adequate current to power the lighting system while charging the maintenance free battery during daylight hours. The maintenance free battery can be sized to ensure adequate reserve current to power the lighting system during night time hours when the solar panel is not in operation.

A main control unit consisting of a single board computer can be provided to control all operation of the lighting system. The main control unit may perform the following functions:

scan the switches for input by a pedestrian requiring the system to be activated;

adjust the brightness of the lighting system;

deactivate the lighting system after a preset time has expired, placing the system in stand-by mode;

monitor the condition of the maintenance free battery and charging system;

monitor all parameters of the lighting system for fault detection; and maintain a log of times and frequency of activations for report generating.

Additional safety features can be added to expand the capabilities of the system, allowing an increased level of security for the pedestrian. These features can be installed with the basic system or added to the system as future expansion requires. For example:

Sensor

A sensor (e.g., ultrasonic, microwave, laser, or other) connected to the system and mounted upstream of the crosswalk can be used to measure the relative speed of traffic approaching the crosswalk and set off an audible alarm, if predetermined limits are exceeded, warning the pedestrian of impending danger. This feature is anticipated to calculate an approaching vehicle's speed and distance, and sound an audible alarm should the computer determine that the vehicle's current speed indicates that the safety of the crosswalk may be violated. The audible alarm can be a spoken message or a simple audible beep, delivered at such a rate and volume as to get the attention of the pedestrian. The ultrasonic sensor may be connected to the main control unit to allow logging of exceeded limit events for use in the main control unit's report generator.

Remote Control

The inventive system may be capable of being controlled remotely by the addition of a communications module. This feature would allow the system to be turned on or off and monitored for general faults by use of either radio or cellular communication. This ability may be useful in cases where the system is used in other applications such as identification of roads and off ramps in impaired visibility areas. In such cases the system could be switched on by the appropriately designated agency(e.g., police, fire, public works, etc.) by a handheld device, from within a passing vehicle, or by long range signalling from a central location when conditions warrant.

Vehicle Signal

A further option would be to install a system by which a signal would be broadcast when the crosswalk signal apparatus was activated and which would be received by a device installed in a vehicle (retrofit to the vehicle, or eventually factory installed) to audibly and/or visually alert the driver of the vehicle that a user has activated the crosswalk system. This could more easily alert the driver to the presence of the crossing pedestrian.

The pedestrian crosswalk signal apparatus of this invention thus provides citizens a low cost and improved degree of personal safety while crossing private or public roadways.

DETAILED DESCRIPTION OF A PREFERRED EMBODIMENT

Figure 1:
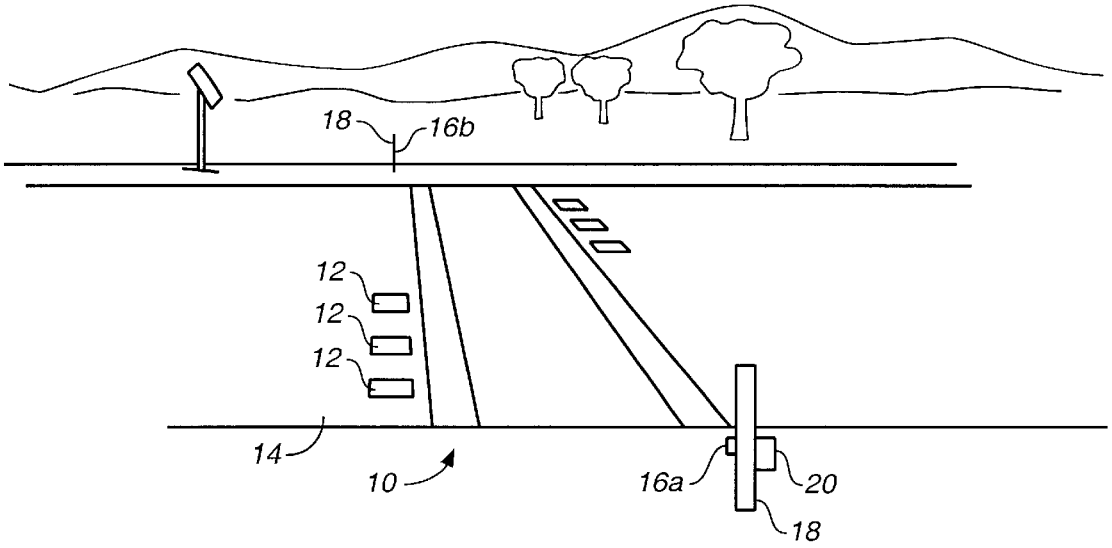
FIG. 1 is a perspective view of a pedestrian crosswalk signal apparatus of this invention as installed in a typical location, illustrating a plurality of light devices embedded in the roadway, and a pair of activation switches mounted on poles on each side of the roadway, this view illustrating a staggered half-width, oncoming traffic lane only installation configuration.

FIG. 1 is a perspective view of a pedestrian crosswalk signal apparatus 10 of this invention as installed in a typical location, illustrating a plurality of light devices 12 embedded in the roadway 14, and a pair of activation switches 16*a, b* mounted on poles 18 on each side of the roadway. The activation switches may consist of a simple mechanical switch 16*a*, or a proximity-type sensor switch 16*b* (such as an ultrasonic sensor, infra-red sensor, optical sensor, microwave sensor, or any other presence-detecting system, such as is well known in the art). This view illustrating a staggered half-width, oncoming traffic lane only installation configuration. Housing 20 may also be mounted on pole 18 and may contain any related hardware, such as solar panels, control circuitry, data storage and report generating apparatus, a backup power supply, ambient light sensors, and a remote communication module, all as discussed supra, and as appropriate.

Figure 2:
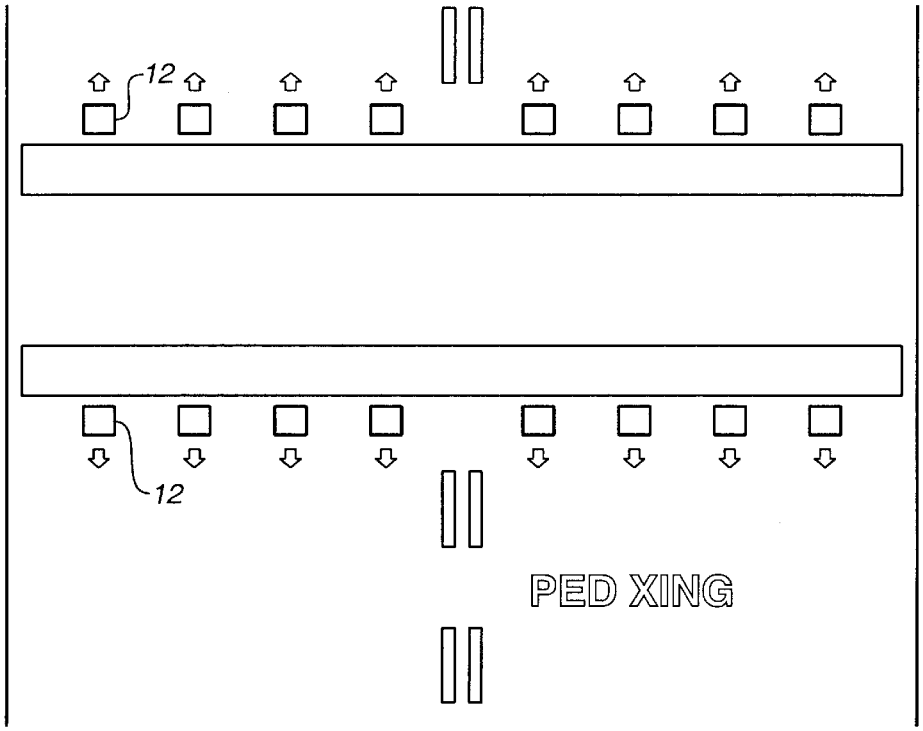
FIG. 2 is a top plan view of an alternate installation for a pedestrian crosswalk signal apparatus of this invention, illustrating a full-width, oncoming and leaving traffic lane installation configuration.

FIG. 2 is a top plan view of an alternate installation for a pedestrian crosswalk signal apparatus of this invention, illustrating a full-width, oncoming and leaving traffic lane installation configuration. In this configuration, light devices 12 display an array of lights entirely across the roadway, in each direction of traffic. This may be desirable to help delineate the entire crosswalk to the driver.

Figure 3:
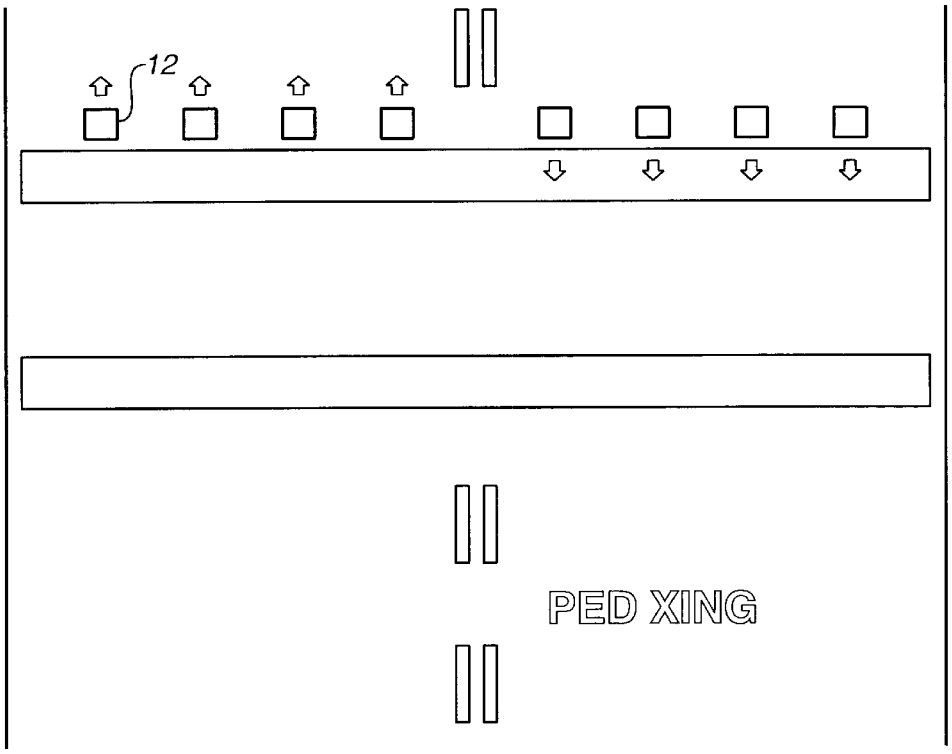
FIG. 3 is a top plan view of an alternate installation for a pedestrian crosswalk signal apparatus of this invention, illustrating a collinear half-width, oncoming traffic lane only installation configuration.

FIG. 3 is a top plan view of an alternate installation for a pedestrian crosswalk signal apparatus of this invention, illustrating a collinear half-width, oncoming traffic lane only installation configuration. In this configuration, light devices 12 display an array of lights in a single line and only across the lane immediately ahead of the approaching driver.

Figure 4:
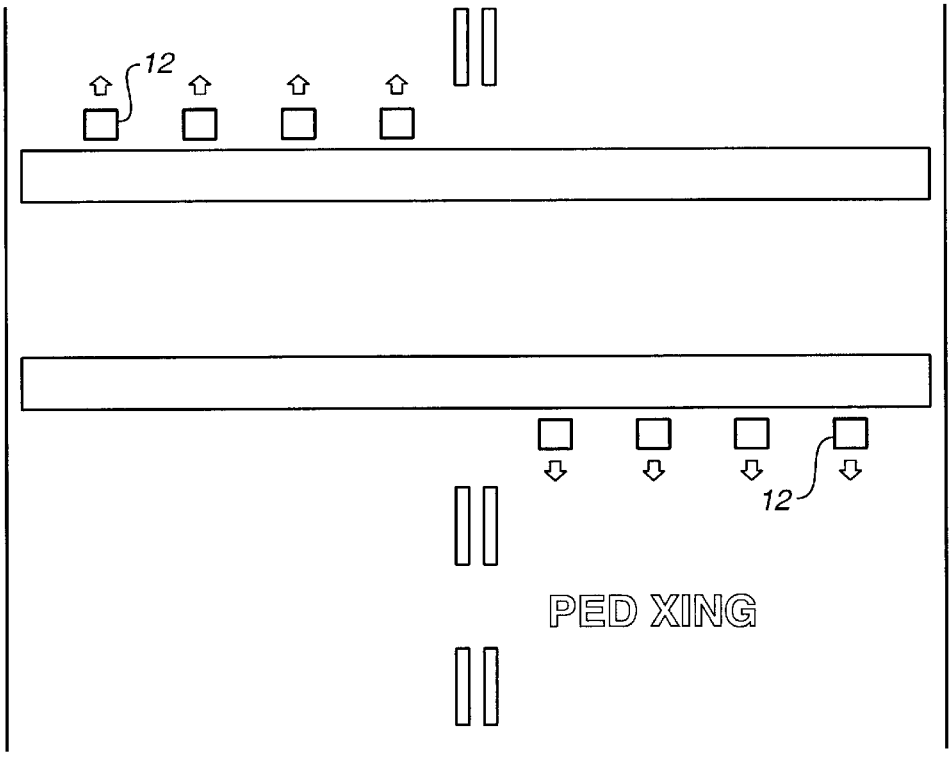
FIG. 4 is a top plan view of the installation of FIG. 1 for a pedestrian crosswalk signal apparatus of this invention, illustrating a staggered half-width, oncoming traffic lane only installation configuration.

FIG. 4 is a top plan view of the installation of FIG. 1 for a pedestrian crosswalk signal apparatus of this invention, illustrating a staggered half-width, oncoming traffic lane only installation configuration. In this configuration, as in the configuration in FIG. 3, light devices 12 display an array of lights only across the lane immediately ahead of the approaching driver. Here, however, the lights are installed in front of the crosswalk in each of the respective lanes, which is desirable to help delineate the vehicle stopping point.

Figure 5:
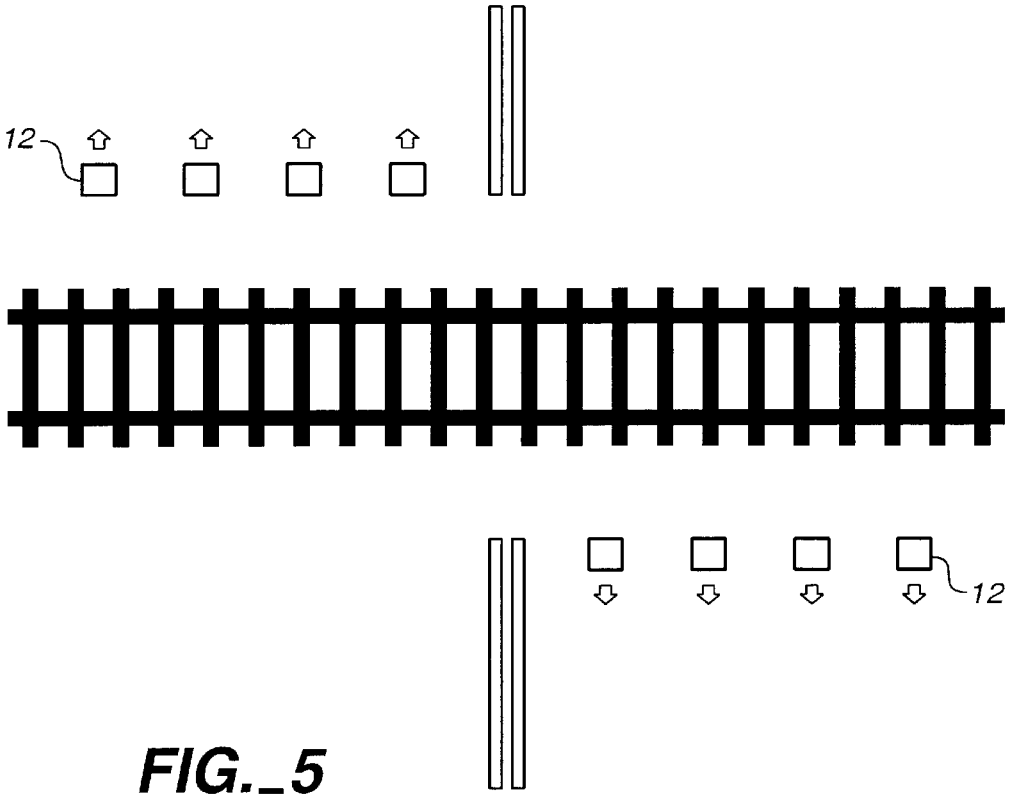
FIG. 5 is a top plan view of an alternate installation for the light devices of the pedestrian crosswalk signal apparatus of this invention, illustrating their use as a supplemental warning system at a railroad crossing.

FIG. 5 is a top plan view of an alternate installation for the light devices 12 of the pedestrian crosswalk signal apparatus of this invention, illustrating their use as a supplemental warning system at a railroad crossing. The light devices of the inventive system could be applied to existing railroad crossings as a low cost upgrade where signal gates are not currently in use.

Figure 6:
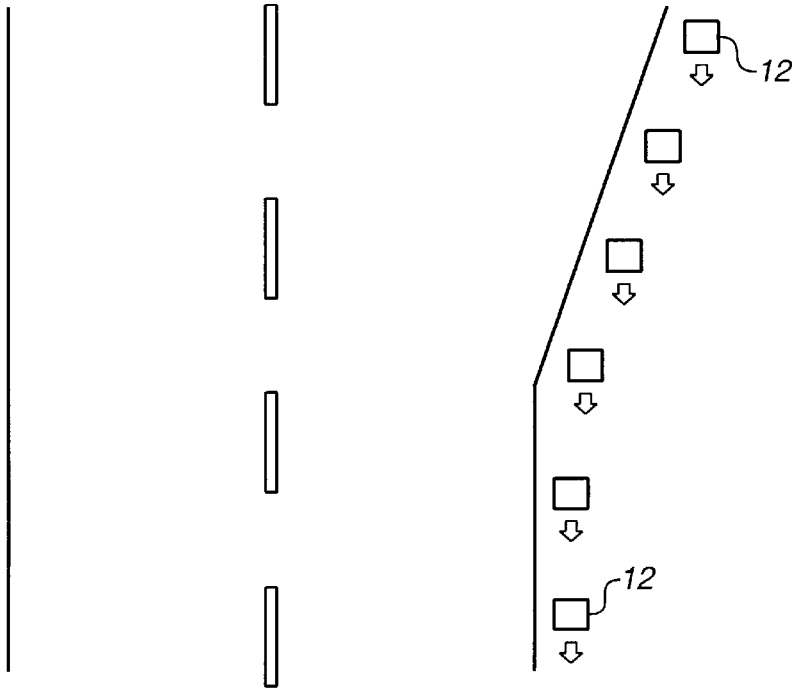
FIG. 6 is a top plan view of an alternate installation for the light devices of the pedestrian crosswalk signal apparatus of this invention, illustrating their use as an off ramp identification system.

FIG. 6 is a top plan view of an alternate installation for the light devices 12 of the pedestrian crosswalk signal apparatus of this invention, illustrating their use as an off ramp identification system. Dense fog areas have always posed safety problems to motorists. Using the light devices of the inventive system to identify off ramps by installing the lights along the side of a roadway would warn a motorist he or she is approaching the exit, and thus eliminate panic braking and a possible rear end collision.

Figures 7, 9:
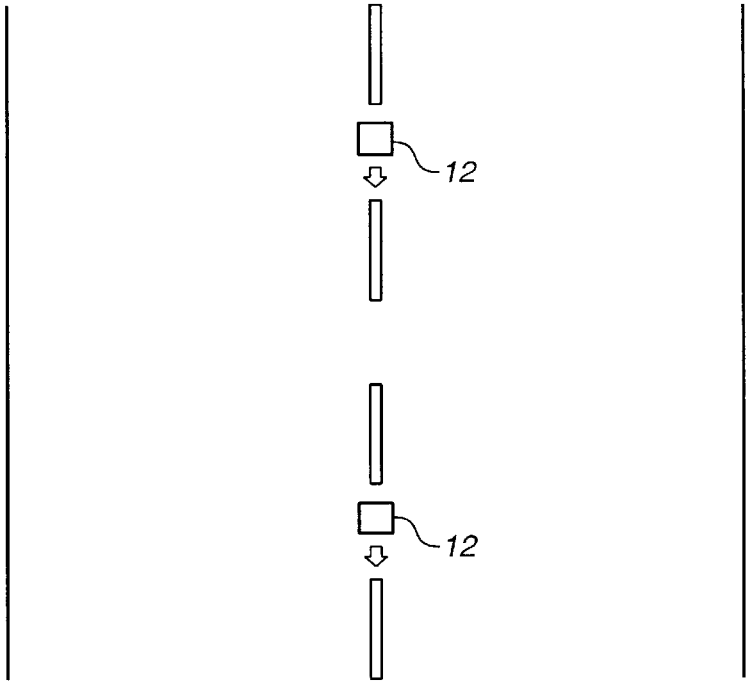
FIG. 7 is a top plan view of an alternate installation for the light devices of the pedestrian crosswalk signal apparatus of this invention, illustrating their use as a roadway median line identification system.
FIG. 9 is a front elevation view of a typical report that may be generated by the pedestrian crosswalk signal apparatus of this invention.

FIG. 7 is a top plan view of an alternate installation for the light devices 12 of the pedestrian crosswalk signal apparatus of this invention, illustrating their use as a roadway median line identification system. A steady stream of lights installed along the roadway's centerline could improve safety to the motorist in areas of dense fog. The use of the communications module (discussed supra) would allow remote activation of the inventive system during periods of dense fog.

Figure 8:
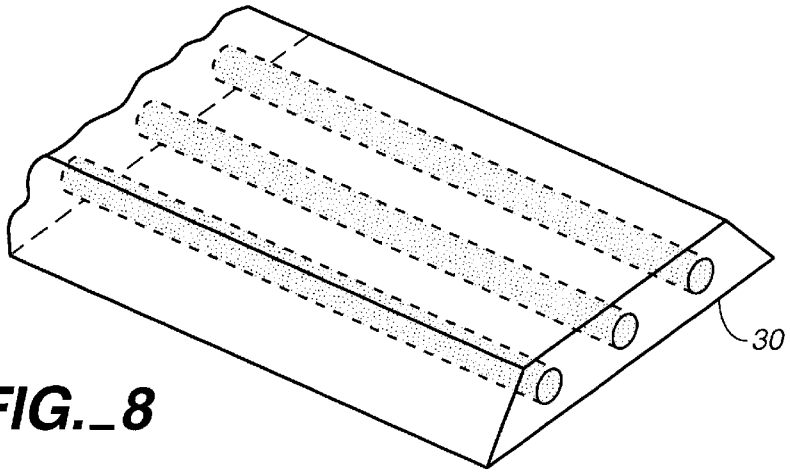
FIG. 8 is a perspective view of an alternate light device embodiment.

FIG. 8 is a perspective view of an alternate light device embodiment, this for a light "bar" 30 that may extend across the roadway in any length or series of segments. The light bar may consist of a fiber optic material, and may be illuminated with a laser or conventional light source.

FIG. 9 is a front elevation view of a typical report 40 that may be generated by the pedestrian crosswalk signal apparatus of this invention.

Figure 10:
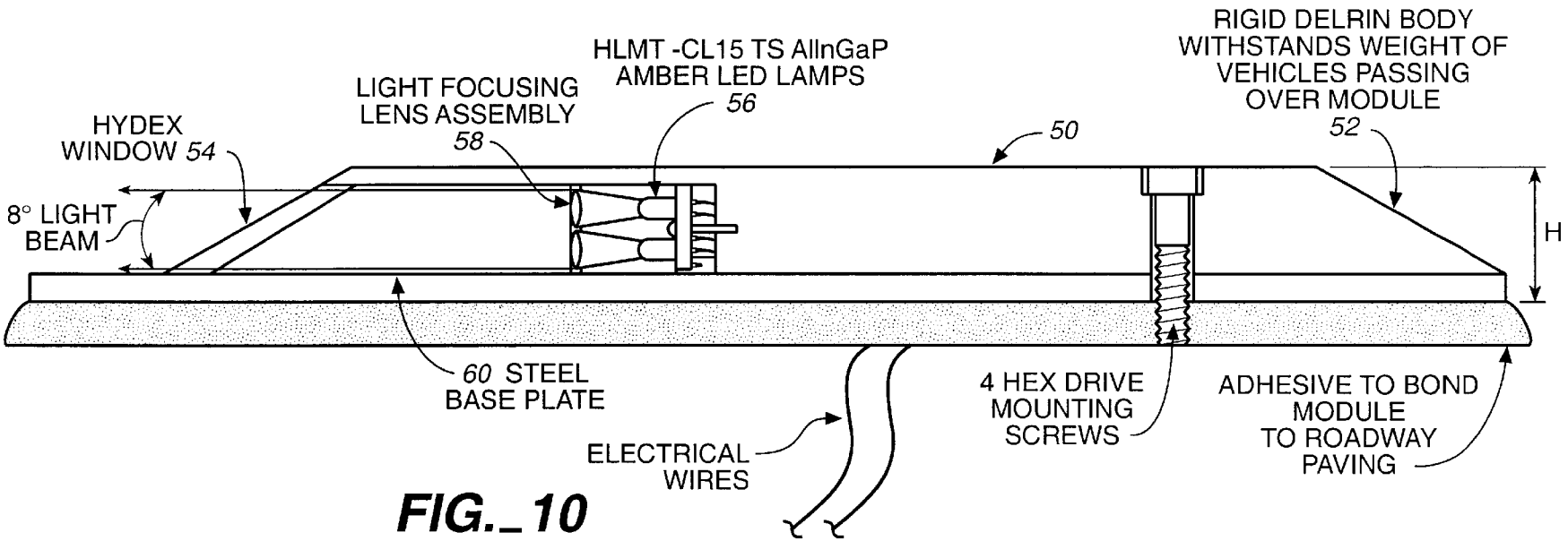
FIG. 10 is a simplified cross-sectional diagram of a light module of this invention.

FIG. 10 is a simplified cross-sectional diagram of an LED (light emitting diode) light module or signalhead 50 of this invention. Durable delrin construction of the module housing 52 withstands the weight of heavy vehicles in passing traffic. The window 54 is of highly abrasion and weather-resistant hydex. Mounted on a small PC board on the inside are the LED lamps 56. Light from the LEDs passes through a lens assembly 58 that focuses the light into a desired beam in the direction of an approaching vehicle, e.g., eight degrees vertical, fourteen degrees horizontal. The modules may have no active LED drive electronics.

The inventive signal head may consist of individual housings containing light emitting diodes which are specifically focused or "aimed" in the direction of oncoming traffic for a pre-determined viewing distance to the driver of an approaching vehicle for maximum effectiveness. The signal head may contain a specifically designed lens for increasing daytime visibility. The signal head may be designed with forward "window" flush surface for self cleaning by auto tires as they cross the face of the signal head occasionally.

The signalhead 50 should preferably have an abovepavement height H of approximately ½ to ¾ inches. While minimal, this physical height (or any other practical height) permits positioning of the light source (e.g., LED lamps 56) above the road surface, enabling the light beam to be directed generally parallel to the road surface (e.g., a vertical angular range of 0 degrees to preferably at least 6 degrees, with a preferable maximum of approximately 15 degrees). This above-pavement, parallel-to-pavement configuration permits the lights to be perceived at a great distance down the roadway, by an observer at a typical height slightly above the roadway surface (i.e., at a range of heights of the eyes of typical drivers seated in typical vehicles driving towards the pedestrian crosswalk). Flush-mounted lights would not provide such visibility.

The surface mounted base plate assembly 60 is specifically designed for road mounting to withstand the harsh environment and resistance to detachment from the road surface and easy mounting of the signal head into position. This base plate also allows for the occasional removal and maintenance of the signal head in minimal time. Alternatively, the base plate may extend into the roadway, to any appropriate depth for secure anchoring (e.g., 2 ½ inches).

The system may include a solar powered or conventionally a/c powered controller which automatically senses ambient light and selects the correct power to the signal heads for viewing effectiveness. The controller may be on demand activated and adjustable for each site specific location. Also, the controller may provide counts and other data base functions for purposes of collection and system use and operation.

The controller may be based on a single board embedded computer, custom micro-controller system, or programmable logic controller (PLC). Optically isolated inputs and outputs may provide monitoring and control of the system.

A 4×20 character LCD display, used in conjunction with a 4×4 matrix keyboard allows an operator to easily modify the programmable settings following a simple menu system.

Analog inputs are provided to allow connection to sensors for monitoring ambient light conditions, solar panel condition, battery charge activity and power supply condition. Ambient light is continuously monitored and the lights are dynamically adjusted to provide the optimum brightness based on current lighting conditions.

Data logging capability is built into the system to allow archiving critical information for historical trending at a later date.

Information which could be useful in analyzing system performance and system usage is written to a removable floppy disk which can be read by a spread sheet program on a host computer for purposes of trending and report generation.

Each time the system is activated, the date and time is logged to a file for historical purposes. This could be useful in cases where liability is an issue. For example, if the system is installed at a rail road crossing and a car is hit by a train, the rail road company could produce a report showing the system was activated at the time of the accident and the driver ignored the warning.

Remote Sensing:

A sensor could be built into new cars by the manufacturer where an audible or visual signal would announce to the driver that a pedestrian is using the crosswalk he or she is approaching. The system controller would broadcast via a low power radio or other signal to activate the sensors within a predetermined range so only the vehicles at or near the crosswalk would be affected.

Remote Control Link:

The controller can be accessed remotely via radio or telephone from a central computer. This could be useful in uploading new parameters to the controller, downloading historical files from the controller or remotely activating the system without actually having to be at the site.

In applications where the system is being used for low visibility off ramp identification, the system could be turned on or off from a central location or by an officer driving down the highway.

Further alternatives include a flexible wiring buss which would be laid across the road and covered by a thick stripping material. The LED lamp assemblies would be attached to the stripe by adhesive and the connections made to the buss by conventional means or by one or more spikes which would penetrate the buss when the lamp is pressed onto the stripe. This method would ease installation and eliminate the need to cut the street.

Alternatively, light pipes similar in design to fiber optic cable could be embedded into the stripping material. A laser coupled into one end of the light pipe could be the light source which would be carried down the light pipes and be emitted at pre-determined locations along the stripe.

The use of the inventive signal heads could serve several purposes to enhance highway safety near off ramps. First, they could provide an advance warning of an off ramp entrance to approaching motorists in reduced visibility conditions (fog, smoke, blowing dust, night). This could be accomplished with a steady burning or unique flash sequence yellow (or other) light emitting signal head positioned at set distances prior to the entrance of the off ramp. The pattern could be similar to standard markings (paint or reflectors) already in use to notify approaching motorists of an off ramp entrance at 0.1 mile intervals. The system could be activated by a passing police car or auto activated with a reduced visibility sensor.

Other problems encountered at off ramps are the wrong way driver and backed-up traffic causing unsafe conditions for a motorist attempting to exit the freeway or throughway. This application could use a series of double-lens signal heads to be viewed from either direction. A wrong way driver would see steady burning red lights activated by a directional sensor when a motorist entered an off ramp traveling in the wrong direction. The red lights would be an additional warning notice to the already in use signs reading "Go Back-You Are Going The Wrong Way". The unsuspecting motorist approaching an exit with a wrong way driver occupying the off ramp would view the other side of the signal heads flashing a yellow warning light to warn the approaching or exiting motorist of a potentially hazardous condition ahead. The signal heads could also be activated by a motion/presence detection system to indicate backed-up traffic on a busy off ramp warning approaching or exiting motorists to pay attention to the potential hazard ahead.

The applications of this system are anticipated to cover a variety of locations including but not limited to:

1) pedestrian crosswalks, a) currently non-signaled, b) previously signalized for auto traffic flow, c) non public owned sites: i.e., shopping centers, amusement parks, airport entrances and parking garages, etc.;
2) emergency applications, a) fire departments ingress/egress, b) hospital emergency ingress/egress, c) emergency vehicle temporary guidance lighting (Highway Patrol, road maintenance crews, etc.);
3) Railroad and light rail applications, a) currently non-signaled crossings, b) enhancement to currently signaled crossings;
4) freeway off ramp guidance lighting, a) low visibility area i.e., frequently foggy locations, b) all freeway off ramps for improved visibility at darkness or periods of low visibility.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A pedestrian crosswalk signal apparatus to alert approaching vehicle traffic to the presence of a pedestrian in a pedestrian crosswalk, said pedestrian crosswalk signal apparatus comprising:

a roadway, said roadway having a surface;

a plurality of signal head members mounted on said roadway surface and extending at least some distance across said roadway and above said roadway surface to at least partially designate a pedestrian crosswalk, each of said signal head members conditioned to withstand contact by vehicle traffic, each of said signal head members including at least one light source adapted to direct a beam of light from said roadway surface in the direction of the approaching vehicle traffic and away from the pedestrian crosswalk, and adjacent to and generally parallel to said roadway surface; and activation means to selectively illuminate said plurality of signal head members light sources to warn the drivers of the approaching vehicles that the pedestrian has entered the pedestrian crosswalk.

2. The pedestrian crosswalk signal apparatus of claim 1 wherein said activation means comprises a mechanical pole-mounted switch.

3. The pedestrian crosswalk signal apparatus of claim 1 wherein said activation means comprises a proximity actuated switch.

4. The pedestrian crosswalk signal apparatus of claim 1 including an ambient light sensing circuit to adjust light intensity to dynamically compensate for poor visibility and night operating conditions.

5. The pedestrian crosswalk signal apparatus of claim 1 including data storage circuitry connected to said activation means to collect additional data related to the activation of said apparatus.

6. The pedestrian crosswalk signal apparatus of claim 5 including report generation circuitry connected to said data storage circuitry.

7. The pedestrian crosswalk signal apparatus of claim 1 including solar power circuitry connected to said activation means to operate said activation means.

8. The pedestrian crosswalk signal apparatus of claim 1 wherein said signal head members have a height of ½ to ¾ inches above said roadway surface.

9. The pedestrian crosswalk signal apparatus of claim 1 wherein said signal head light source comprises light emitting diodes.

10. The pedestrian crosswalk signal apparatus of claim 1 wherein said signal head light source is directed in a beam having a vertical angular range of 0 degrees to 5 degrees.

11. The pedestrian crosswalk signal apparatus of claim 1 wherein said signal head members are installed facing only oncoming vehicle traffic.

12. The pedestrian crosswalk signal apparatus of claim 1 wherein said signal head members are installed across the entire length of the pedestrian crosswalk.

13. The pedestrian crosswalk signal apparatus of claims 1 wherein said beam of light flashes in a predetermined sequence, and remains flashing for a predetermined time.

14. The pedestrian crosswalk signal apparatus of claim 1 wherein said signal head member includes a lens assembly to focus light into a beam in the direction of an approaching vehicle.

15. The pedestrian crosswalk signal apparatus of claim 1 wherein said plurality of signal head members each include a base plate portion embedded in said roadway.

* * * * *

US006384742C1

(12) EX PARTE REEXAMINATION CERTIFICATE (6046th)

United States Patent

Harrison

(10) Number: US 6,384,742 C1

(45) Certificate Issued: Dec. 11, 2007

(54) PEDESTRIAN CROSSWALK SIGNAL APPARATUS—PEDESTRIAN CROSSWALK

(76) Inventor: Michael A. Harrison, 10992 Rio Ruso Dr., Windsor, CA (US) 95492

Reexamination Request:
No. 90/007,722, Sep. 16, 2005

Reexamination Certificate for:

| | |
|---|---|
| Patent No.: | **6,384,742** |
| Issued: | **May 7, 2002** |
| Appl. No.: | **09/649,639** |
| Filed: | **Aug. 28, 2000** |

Related U.S. Application Data

(63) Continuation-in-part of application No. 09/039,877, filed on Mar. 16, 1998, now abandoned, which is a continuation-in-part of application No. 08/680,275, filed on Jul. 11, 1996, now abandoned, which is a continuation-in-part of application No. 08/257,334, filed on Jun. 8, 1994, now abandoned.

(51) Int. Cl.

| | |
|---|---|
| ***E01F 9/06*** | (2006.01) |
| ***E01F 9/04*** | (2006.01) |
| ***G08G 1/005*** | (2006.01) |
| ***G08G 1/095*** | (2006.01) |

(52) U.S. Cl. ..... 340/944; 340/980.1; 340/925; 340/917

(58) Field of Classification Search ..... None
See application file for complete search history.

(56) References Cited

U.S. PATENT DOCUMENTS 4,570,207 A 2/1986 Takahashi et al.

FOREIGN PATENT DOCUMENTS

FR 2665914 A1 2/1992

*Primary Examiner*—Majid Banankhah

(57) ABSTRACT

A traffic warning system which alerts approaching vehicle traffic to the presence of a pedestrian in a crosswalk. The system includes a plurality of surface mounted lights partially embedded in and placed across a roadway. The lights are activated by the pedestrian, either by manual switch or by a sensor, before he enters the crosswalk. Once activated, the flashing lights warn drivers of approaching vehicles that the pedestrian may have entered the crosswalk, and that caution should be exercised.

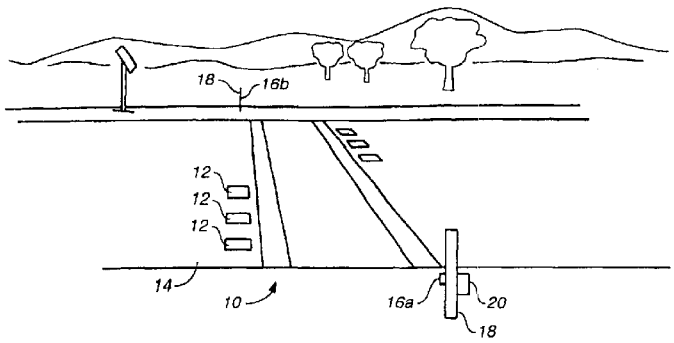

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–15 is confirmed.

* * * * *